US011305341B2

(12) United States Patent
Asaoka et al.

(10) Patent No.: US 11,305,341 B2
(45) Date of Patent: Apr. 19, 2022

(54) MOLD SHAKEOUT SYSTEM

(71) Applicant: SINTOKOGIO, LTD., Nagoya (JP)

(72) Inventors: Yasuaki Asaoka, Toyokawa (JP); Hisashi Harada, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 16/639,181

(22) PCT Filed: Jul. 13, 2018

(86) PCT No.: PCT/JP2018/026429
§ 371 (c)(1),
(2) Date: Feb. 14, 2020

(87) PCT Pub. No.: WO2019/097759
PCT Pub. Date: May 23, 2019

(65) Prior Publication Data

US 2021/0162494 A1 Jun. 3, 2021

(30) Foreign Application Priority Data

Nov. 15, 2017 (JP) ..... JP2017-219868

(51) Int. Cl.
*B22D 29/00* (2006.01)
*B22D 29/04* (2006.01)
*B22D 46/00* (2006.01)

(52) U.S. Cl.
CPC ..... *B22D 29/00* (2013.01); *B22D 29/04* (2013.01); *B22D 46/00* (2013.01)

(58) Field of Classification Search
CPC .. B22C 5/08; B22C 5/085; B22C 5/10; B22C 5/18; B22C 5/185; B22D 29/00; B22D 29/04
See application file for complete search history.

(56) References Cited

U.S. PATENT DOCUMENTS 4,154,290 A * 5/1979 Weststrate ..... B22C 5/085 164/404
4,209,055 A * 6/1980 Buhler ..... B22C 5/085 164/131
(Continued)

FOREIGN PATENT DOCUMENTS

JP S56-014068 A 2/1981
JP S56-126421 A 10/1981
(Continued)

OTHER PUBLICATIONS

Aug. 21, 2018 Search Report issued in International Patent Application No. PCT/JP2018/026429.

*Primary Examiner* — Kevin E Yoon
(74) *Attorney, Agent, or Firm* — Oliff PLC

(57) ABSTRACT

A mold shake-out system to suppress the effects of an excessive or insufficient water sprinkling amount in mold shake-out that separates a mold, into which castings have been poured, into castings and molding sand, the mold shake-out system including: a shake-out device that separates the castings and a mold into the castings and the molding sand; a water sprinkling portion that sprinkles water in the shake-out device; and a control device that controls the water sprinkling amount in the water sprinkling portion; the control device adjusting the water sprinkling amount on the basis of molding/pouring data including molding data regarding the mold into which castings have been poured and which is loaded into the shake-out device, pouring data regarding molten metal that forms the castings, and time data from when the molten metal is poured into the mold until when the mold is loaded into the shake-out device.

4 Claims, 5 Drawing Sheets

(56) References Cited

U.S. PATENT DOCUMENTS

| | | | | | |
|---|---|---|---|---|---|
| 4,231,414 | A * | 11/1980 | Wallwork | B22C 5/085 | 134/57 R |
| 5,054,538 | A * | 10/1991 | Ibsen | B22D 47/02 | 164/323 |
| 5,505,247 | A | 4/1996 | Musschoot | | |
| 5,515,907 | A * | 5/1996 | Boenisch | B22C 5/00 | 164/456 |
| 2019/0351479 | A1 * | 11/2019 | Federhen | C22B 5/00 | |

FOREIGN PATENT DOCUMENTS

| | | | | |
|---|---|---|---|---|
| JP | 58159941 | A * | 9/1983 | B22C 5/085 |
| JP | S58-159941 | A | 9/1983 | |
| JP | S64-075023 | A | 3/1989 | |
| JP | H06-328228 | A | 11/1994 | |
| JP | H09-271929 | A | 10/1997 | |
| JP | H11-221649 | A | 8/1999 | |

* cited by examiner

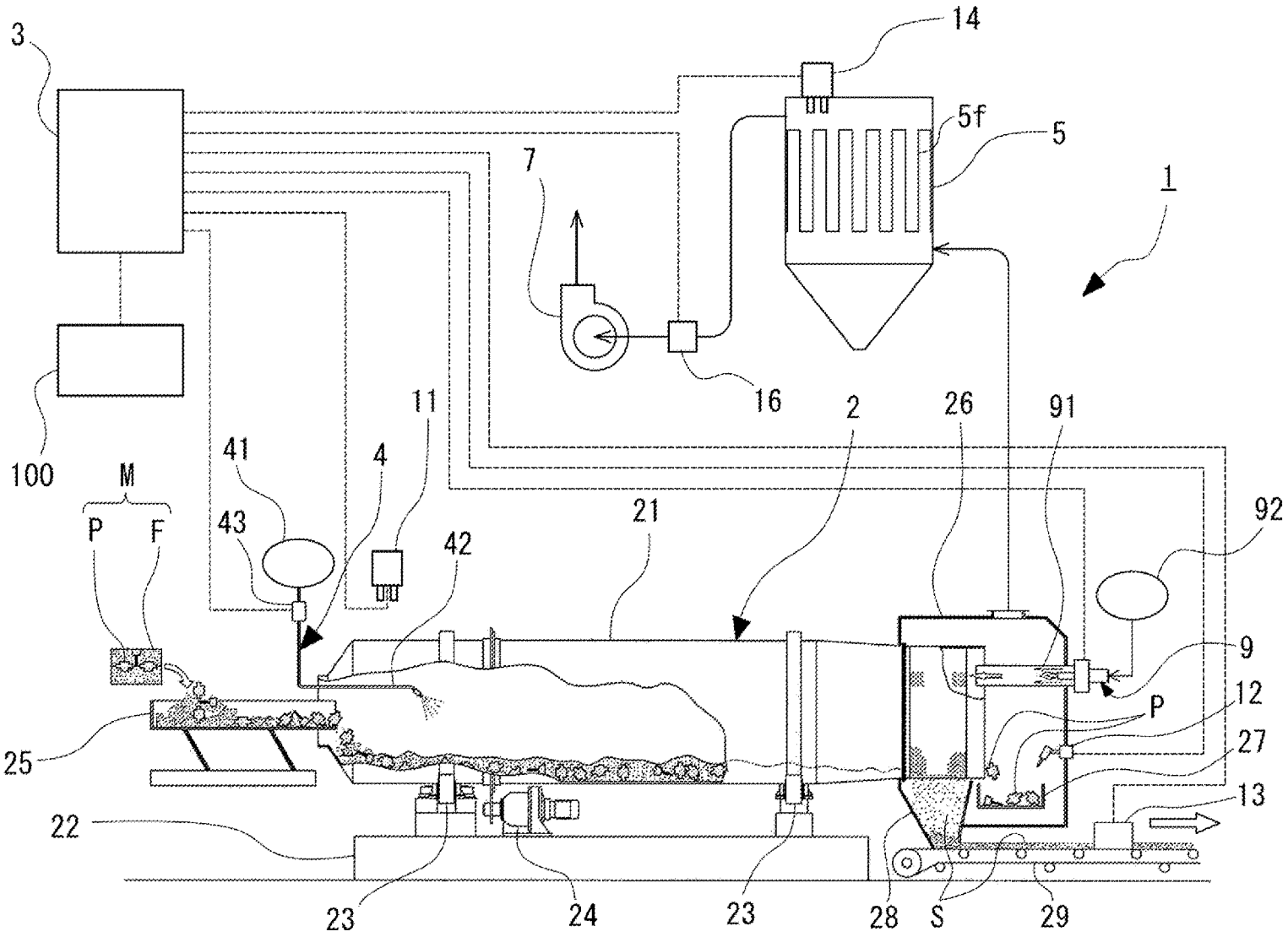
[FIG. 1]

[FIG. 2]
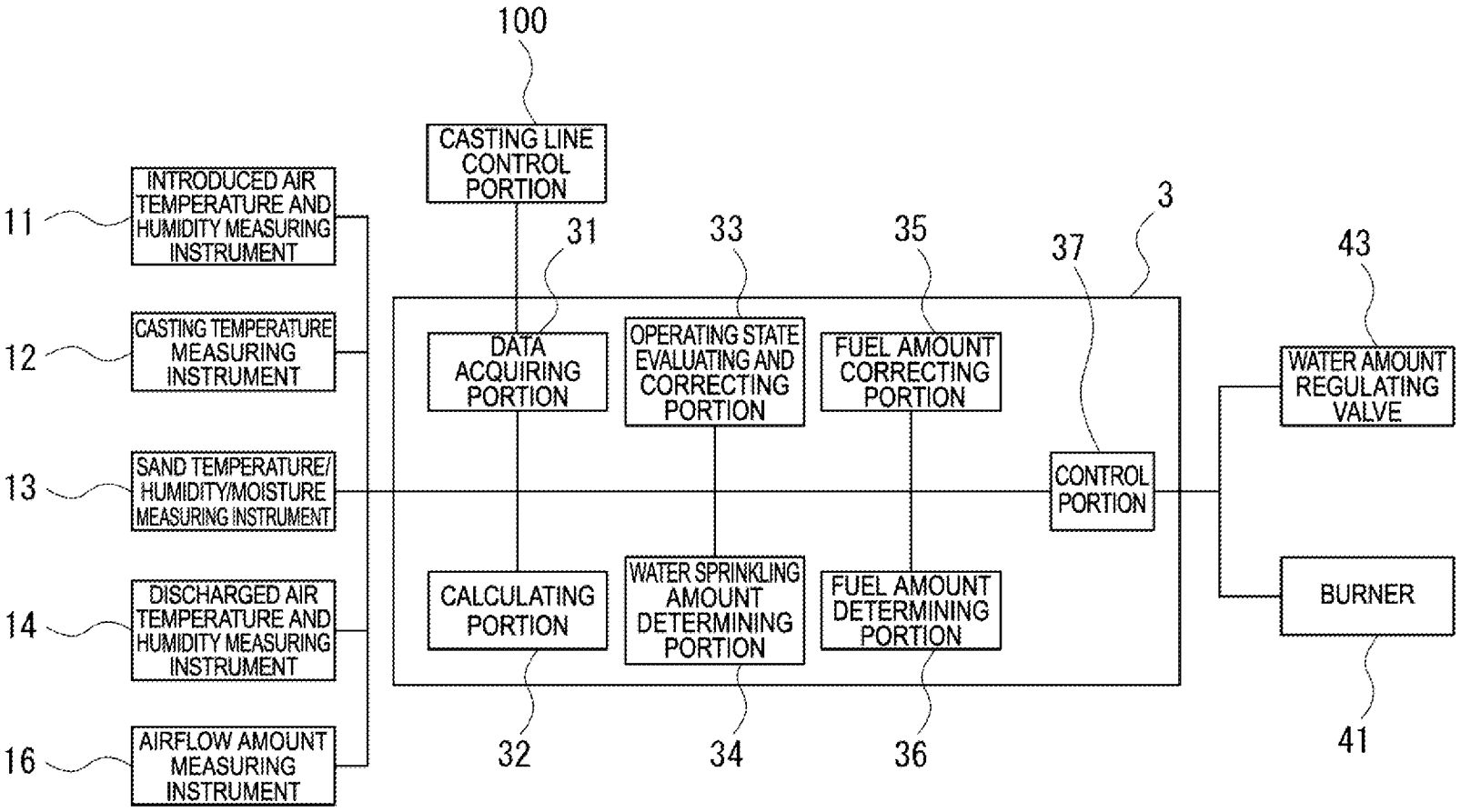

[FIG. 3]
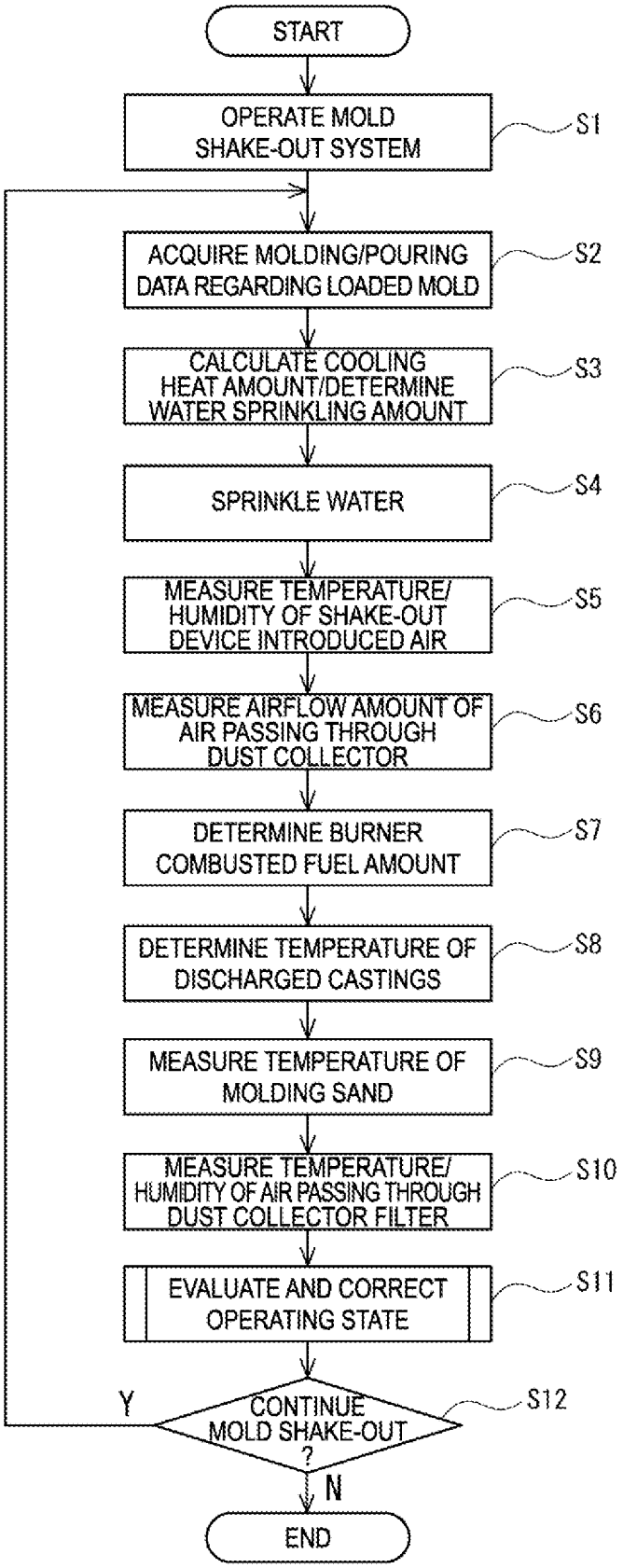

[FIG. 4]
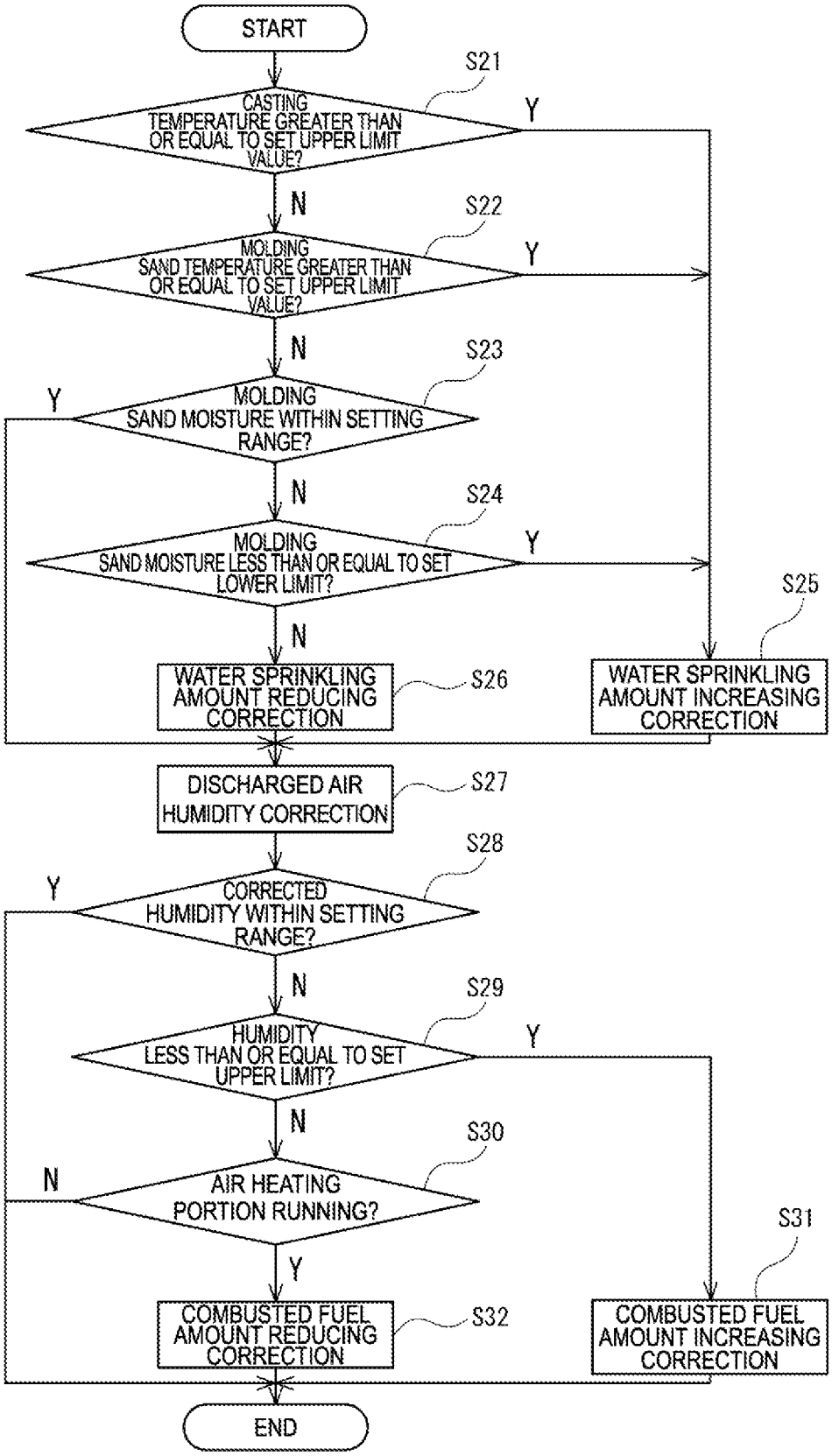

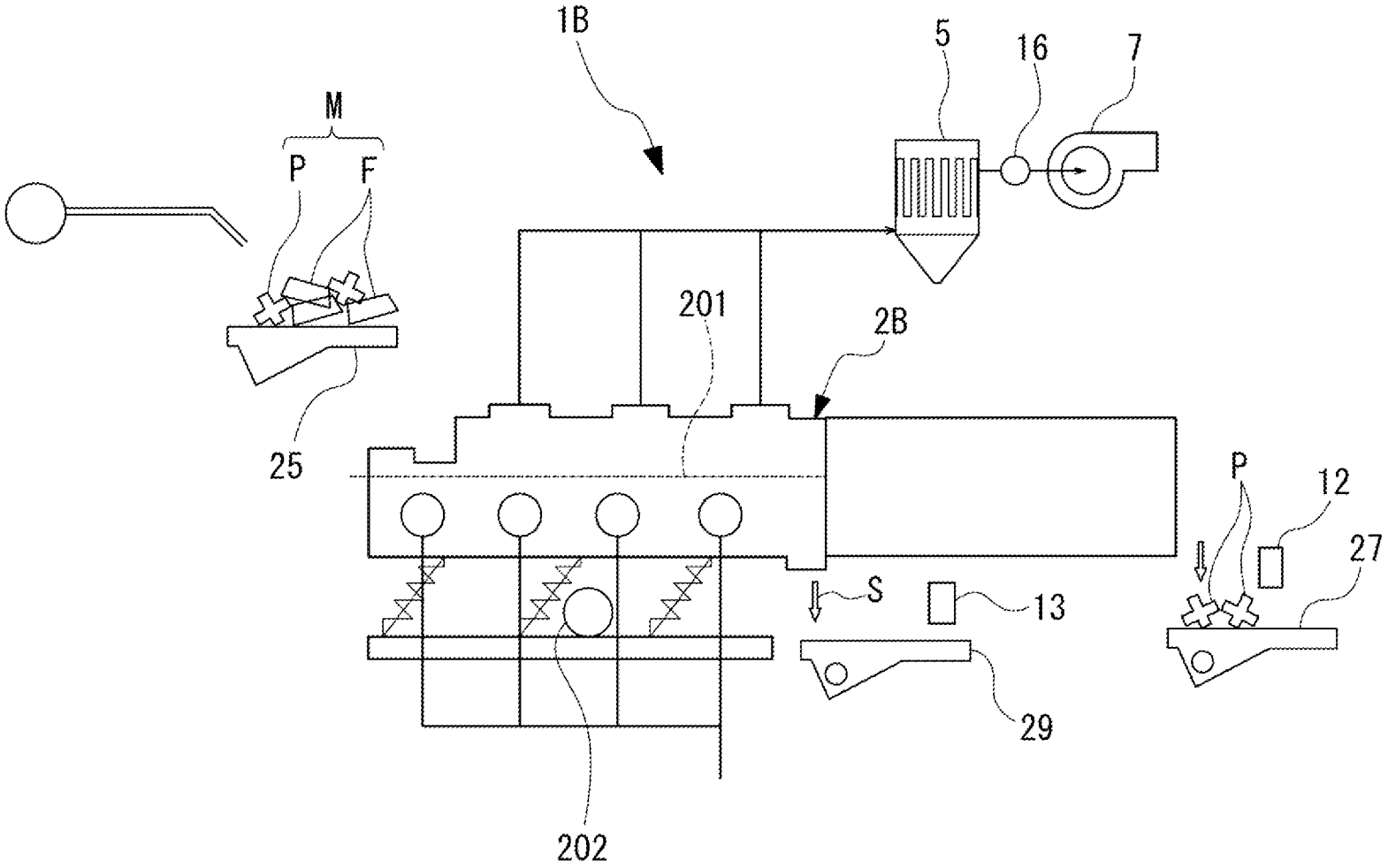
[FIG. 5]

MOLD SHAKEOUT SYSTEM

TECHNICAL FIELD

The present invention relates to a mold shake-out system.

BACKGROUND

In performing casting in a casting line, molten metal is poured into molds, the molten metal solidifies and is cooled, and then mold shake-out is performed. In mold shake-out, castings and molding sand are separated. The separated castings are made into products, and the molding sand is recovered and reused.

In order to perform such mold shake-out, mold shake-out devices, such as rotating drum types, vibrating trough types, and vibrating drum types are used. In mold shake-out devices, water may be sprinkled inside the devices to promote the cooling of the castings and the molding sand. For example, Patent Document 1 discloses the configuration in which the radiant heat of castings is measured before the castings are conveyed to a rotating drum type cooling device and the water sprinkling amount is controlled on the basis of the measured temperature.

CITATION LIST

Patent Documents

Patent Document 1: JP S56-14068 A

SUMMARY OF INVENTION

Technical Problem

However, if the water sprinkling amount is insufficient, adequate cooling of the castings and the molding sand is not performed. In addition, an excessive or insufficient water sprinkling amount can, for example, result in the temperature or moisture content of molding sand that has been recovered being too high, leading to difficulties in reusing the molding sand. In this manner, an excessive or insufficient water sprinkling amount in mold shake-out can have various effects.

Therefore, an object of the present invention is to provide a mold shake-out system capable of suppressing the effects of an excessive or insufficient water sprinkling amount in mold shake-out.

Solution to Problem

To solve the problem described above, the present invention employs the means below.

That is, the mold shake-out system of the present invention is a mold shake-out system that separates a mold, into which a casting has been poured, into the casting and molding sand, the mold shake-out system comprising: a shake-out device that separates the casting and the mold into the casting and the molding sand; a water sprinkling portion that sprinkles water in the shake-out device; and a control device that controls the water sprinkling amount in the water sprinkling portion; and the control device adjusts the water sprinkling amount on the basis of molding/pouring data comprising molding data regarding the mold into which the casting has been poured and which is loaded into the mold shake-out device, pouring data regarding molten metal that forms the casting, and time data from when the molten metal is poured into the mold until when the mold is loaded into the shake-out device.

According to such a configuration, the water sprinkling amount is adjusted on the basis of molding data, pouring data, and molding/pouring data. This makes it possible to obtain the amount of heat of the mold, into which the casting has been poured, before the mold is loaded into the shake-out device. Accordingly, it is possible to suppress the occurrence of an excessive or insufficient water sprinkling amount with higher accuracy by adjusting the water sprinkling amount on the basis of the obtained amount of heat.

In addition, a configuration is also possible in which the mold shake-out system of the present invention further comprises a casting temperature measuring portion that measures the temperature of the casting discharged from the shake-out device, and a sand temperature and moisture measuring portion that measures the temperature and moisture of the molding sand discharged from the shake-out device, and the control device adjusts the water sprinkling amount on the basis of: the molding data regarding the mold, the pouring data regarding the molten metal, and the molding/pouring data; the temperature of the casting discharged from the shake-out device; and the temperature and moisture of the molding sand.

According to such a configuration, it is possible to suppress the occurrence of an excessive or insufficient water sprinkling amount with greater accuracy by adjusting the water sprinkling amount on the basis of the temperature of the casting discharged from the shake-out device and the temperature and moisture of the molding sand in addition to the molding data regarding the mold, the pouring data regarding the molten metal, and the molding/pouring data.

In addition, a configuration is also possible in which the mold shake-out system of the present invention comprises an air introducing portion that introduces air into the shake-out device, an introduced air temperature and humidity measuring portion that measures the temperature and humidity of the air introduced into the shake-out device, and an airflow amount measuring portion that measures the airflow amount of the air, and the control device adjusts the water sprinkling amount on the basis of the temperature, humidity, and airflow amount of the introduced air.

According to such a configuration, it is possible to suppress the occurrence of an excessive or insufficient water sprinkling amount with greater accuracy by adjusting the water sprinkling amount on the basis of the temperature, humidity, and airflow amount of the air introduced into the shake-out device.

In addition, a configuration is also possible in which the mold shake-out system of the present invention further comprises a dust collecting device that removes dust contained in the air discharged from the shake-out device and a discharged air temperature and humidity measuring portion that measures the temperature and humidity of discharged air discharged from the dust collecting device, and the control device adjusts the water sprinkling amount on the basis of the temperature and humidity of the air measured by the introduced air temperature and humidity measuring portion, the airflow amount measured by the airflow amount measuring portion, and the temperature and humidity of the discharged air measured by the discharged air temperature and humidity measuring portion.

According to such a configuration, the water sprinkling amount is adjusted on the basis of the temperature, humidity, and airflow amount of the air introduced into the shake-out device, and the temperature and humidity of the discharged air. This makes it possible to obtain the amount of heat taken from the casting and the molding sand by the latent heat of vaporization when sprinkled water evaporates inside the shake-out device. By adjusting the water sprinkling amount on the basis of the amount of heat obtained in this manner, it is possible to suppress the occurrence of an excessive or insufficient water sprinkling amount with greater accuracy.

In addition, a configuration is also possible in which the mold shake-out system of the present invention further comprises an air heating portion that heats air inside the shake-out device, and the control device adjusts the temperature and humidity of the air discharged from the shake-out device and fed into the dust collecting device by controlling the air heating portion on the basis of the temperature and humidity of the air measured by the introduced air temperature and humidity measuring portion, the airflow amount measured by the airflow amount measuring portion, and the temperature and humidity of the discharged air measured by the discharged air temperature and humidity measuring portion.

According to such a configuration, it is possible to obtain the amount of heat taken from the casting and the molding sand by the latent heat of vaporization when sprinkled water evaporates inside the shake-out device on the basis of the temperature, humidity, and airflow amount of the air introduced into the shake-out device and the temperature and humidity of the discharged air. By adjusting the amount of hot air fed into the shake-out device on the basis of the amount of heat obtained in this manner, it is possible to adjust the temperature and humidity of the air fed into the dust collecting device. As a result, it is possible to suppress condensation in the air introduction path from the shake-out device to the air introducing device.

The mold shake-out system of the present invention is a mold shake-out system that separates a mold, into which a casting has been poured, into the casting and molding sand, the mold shake-out system comprising: a shake-out device that separates the casting and the mold into the casting and the molding sand; an air introducing portion that introduces air into the shake-out device; an airflow amount measuring portion that measures the airflow amount of introduced air introduced into the shake-out device; an air heating portion that heats air inside the shake-out device; a dust collecting device that removes dust contained in the air discharged from the shake-out device; a discharged air temperature and humidity measuring portion that measures the temperature and humidity of discharged air discharged from the dust collecting device; and an air heating control device that controls the air heating portion; and the air heating control device adjusts the temperature and humidity of the air discharged from the shake-out device and fed into the dust collecting device by controlling the air heating portion on the basis of: the airflow amount measured by the airflow amount measuring portion; and the temperature and humidity of the discharged air measured by the discharged air temperature and humidity measuring portion.

According to such a configuration, it is possible to obtain the amount of heat taken from the casting and the molding sand by the latent heat of vaporization when sprinkled water evaporates inside the shake-out device on the basis of the airflow amount of the air introduced into the shake-out device and the temperature and humidity of the discharged air. By adjusting the amount of hot air fed into the shake-out device on the basis of the amount of heat obtained in this manner, it is possible to adjust the temperature and humidity of the air fed into the dust collecting device. As a result, it is possible to suppress condensation in the air introduction path from the shake-out device to the air introducing device. This makes it possible to suppress the effects of an excessive or insufficient water sprinkling amount from influencing the dust collecting device downstream of the shake-out device.

In addition, a configuration is also possible in which the mold shake-out system of the present invention further comprises an introduced air temperature and humidity measuring portion that measures the temperature and humidity of the introduced air introduced into the shake-out device, and the air heating control device adjusts the temperature and humidity of the air discharged from the shake-out device and fed into the dust collecting device by controlling the air heating portion on the basis of the temperature and humidity of the introduced air measured by the introduced air temperature and humidity measuring portion, the airflow amount, and the temperature and humidity of the discharged air.

According to such a configuration, it is possible to adjust the temperature and humidity of the air fed into the dust collecting device by adjusting the amount of hot air fed into the shake-out device on the basis of the temperature and humidity of the introduced air in addition to the airflow amount of the air introduced into the shake-out device and the temperature and humidity of the discharged air. As a result, it is possible to suppress condensation in the air introduction path from the shake-out device to the air introducing device. This makes it possible to suppress the effects of an excessive or insufficient water sprinkling amount from influencing the dust collecting device downstream of the shake-out device.

Advantageous Effects of Invention

According to the present invention, it is possible to adjust the water sprinkling amount in mold shake-out with higher accuracy.

BRIEF DESCRIPTION OF DRAWINGS

FIG. 1 is a schematic view of a mold shake-out system 1 illustrated as an embodiment of the present invention.

FIG. 2 is a block diagram illustrating a functional configuration of a control device in the present embodiment.

FIG. 3 is a flow chart illustrating the flow of control executed by the control device in the present embodiment.

FIG. 4 is a flow chart illustrating the flow of processes for performing evaluation and correction of the operating state of the mold shake-out system in the control device in the present embodiment.

FIG. 5 illustrates a variation of a shake-out device used in the mold shake-out system in the present embodiment.

DESCRIPTION OF EMBODIMENTS

An embodiment of the present invention is described in detail below with reference to the drawings.

FIG. 1 is a schematic view of the mold shake-out system 1 illustrated as an embodiment of the present invention.

The mold shake-out system 1 illustrated in FIG. 1 breaks down a mold F into which castings P have been poured, separates the castings P and molding sand S, and cools the castings P and the molding sand S together. Here, the mold F into which castings P have been poured refers, in green sand casting, to a state in which molten metal has solidified after being poured into a mold F and castings P have been embedded in the mold F. Hereinafter, the mold F into which castings P have been poured shall be referred to as a loaded mold M.

The mold shake-out system 1 mainly comprises a rotating drum type shake-out device 2, a water sprinkling portion 4, a dust collecting device 5, an air introducing device (air introducing portion) 7, an air heating portion 9, and a control device 3 (air heating control device).

The shake-out device 2 comprises a drum 21, rollers 23 provided on a base 22, and a drive motor 24 that rotationally drives the drum 21.

The drum 21 is formed in a cylindrical shape and is disposed with the central axis thereof oriented in a substantially horizontal direction.

Rollers 23 are provided on both sides of the drum 21 in the axial direction. The rollers 23 support the drum 21 so as to allow rotation about the central axis.

The drive motor 24 transmits the rotational movement thereof to the drum 21 via a chain and sprocket. The drum 21 thereby rotates about the central axis thereof.

The loaded mold M is loaded into the drum 21. In the drum 21, the loaded mold M is shaken out and separated into castings P and molding sand S.

A mold conveying device 25 is provided on the loading side of the shake-out device 2. The mold conveying device 25 loads loaded molds M sent from a casting line not shown into the drum 21 of the shake-out device 2.

A hood 26 is provided on the discharge side of the shake-out device 2. A conveyor 27 is provided inside the hood 26. The conveyor 27 transports castings P separated from molds F outside of the mold shake-out system 1.

In addition, a screen is provided at the end of the shake-out device 2. The screen is for screening the molding sand S separated from the castings P and broken up by the rotating motion of the drum 21. The screened molding sand S is collected by a chute 28 and discharged onto a belt conveyor 29. The discharged molding sand S is transported out by the belt conveyor 29.

The temperature of the castings P transported out by the conveyor 27 is measured by a casting temperature measuring instrument (casting temperature measuring portion) 12. The casting temperature measuring instrument 12 is electrically connected to the control device 3. Data regarding the measured temperature of the castings P is sent to the control device 3.

In addition, a sand temperature and moisture measuring instrument (sand temperature and moisture measuring portion) 13 is provided on the belt conveyor 29 and the temperature and moisture of the molding sand S that is transported out are measured. The sand temperature and moisture measuring instrument 13 is electrically connected to the control device 3. Data regarding the measured temperature and moisture of the molding sand S is sent to the control device 3.

The water sprinkling portion 4 sprinkles water inside the drum 21 of the shake-out device 2. The water sprinkling portion 4 comprises a water supply source 41, water sprinkling piping 42, and a water amount regulating valve 43.

The water supply source 41 supplies water to the water sprinkling piping 42.

The tip of the water sprinkling piping 42 extends into the drum 21. The water sprinkling piping 42 disperses water supplied from the water supply source 41 inside the drum 21.

The water amount regulating valve 43 regulates the flow rate of water passing through the water sprinkling piping 42. The water amount regulating valve 43 is electrically connected to the control device 3 and regulates the degree of opening thereof in response to the water amount calculated by the control device 3.

The air inlet side of the dust collecting device 5 is connected to the hood 26. The air outlet side of the dust collecting device 5 is connected to the air introducing device 7. The dust collecting device 5 comprises a filter **5*f* therein and removes dust contained in the air discharged from the shake-out device 2 by means of the filter 5*f***.

The air introducing device 7 introduces air into the shake-out device 2. Outside air flows from the loading side of the shake-out device 2 into the drum 21 by the flow of air generated by the air introducing device 7. The air that has flowed in passes through the inside of the drum 21 and, through the hood 26, reaches the dust collecting device 5. The air that has passed through the filter in the dust collecting device 5 is discharged outside through the air introducing device 7.

In the course of such a flow of air, the temperature and humidity of the outside air (introduced air) that flows into the drum 21 of the shake-out device 2 are measured by the introduced air temperature and humidity measuring instrument (introduced air temperature and humidity measuring portion) 11. In addition, the temperature and the humidity of the air (discharged air) that passes through the filter in the dust collecting device 5 are measured by the discharged air temperature and humidity measuring instrument (discharged air temperature and humidity measuring portion) 14. Furthermore, the airflow amount of air to the air introducing device 7 is measured by an airflow amount measuring instrument (airflow amount measuring portion) 16 provided between the dust collecting device and the air introducing device 7.

The introduced air temperature and humidity measuring instrument 11 is electrically connected to the control device 3. Data regarding the temperature and humidity of the introduced air is sent to the control device 3. In addition, the discharged air temperature and humidity measuring instrument 14 is also electrically connected to the control device 3. Data regarding the temperature and humidity of the discharged air is sent to the control device 3. Furthermore, the airflow amount measuring instrument 16 is also electrically connected to the control device 3. Data regarding the amount of airflow to the air introducing device 7 is sent to the control device 3.

The air heating portion 9 comprises a burner 91 and a fuel supply source 92. The burner 91 is provided on one side of the hood 26. The fuel supply source 92 supplies fuel to the burner 91. The fuel supply source 92 uses a fossil fuel as the fuel in the present embodiment.

The air heating portion 9 combusts the fuel supplied from the fuel supply source 92 with the burner 91 to spray a combustion gas in the shake-out device 2 and heat the air inside the shake-out device 2. The air heating portion 9 adjusts the temperature of the air sent to the dust collecting device 5 by means of the combustion state of the burner 91.

The burner 91 is electrically connected to the control device 3. The combustion state of the burner 91 is controlled by a command from the control device 3.

The control device 3 controls the operation of the mold shake-out system 1 by appropriately adjusting the amount of water sprinkled inside the drum 21 of the shake-out device 2 and the state of the air that passes through the drum 21.

A casting line control portion 100 is electrically connected to the control device 3, and the control device 3 acquires molding/pouring data regarding the molds F that are loaded into the shake-out device 2.

FIG. 2 is a block diagram illustrating a functional configuration of the control device 3.

As illustrated in FIG. 2, the control device 3 comprises a data acquiring portion 31, a calculating portion 32, a water sprinkling amount determining portion 34, a fuel amount determining portion 36, and a control portion 37.

The data acquiring portion 31 calculates the amount of heat of the loaded mold M that is loaded into the shake-out device 2 based on the sand weight, temperature, moisture, and molding time of the mold F and the material, temperature, pouring weight, and pouring time of the molten metal at the time of pouring obtained from the casting line control portion 100.

The calculating portion 32 performs water sprinkling amount adjustment (latent heat of vaporization) with the target amount of heat of the castings P and the molding sand S discharged from the shake-out device 2, based on the amount of heat of the mold M and the castings P loaded into the shake-out device 2. This involves the calculating portion 32 obtaining the amount of heat of the castings P and the molding sand S when the temperature of the castings P discharged from the shake-out device 2 and the temperature and moisture of the recovered molding sand S reach predetermined target values. The calculating portion 32 subtracts the target amount of heat of the discharged castings P and the molding sand S from the amount of heat of the loaded mold M calculated by the data acquiring portion 31 to calculate the cooling heat amount by being cooled by the shake-out device 2. In addition, the water sprinkling amount corresponding to the calculated cooling heat amount is calculated for performing the cooling by means of latent heat (latent heat of vaporization) by the evaporation of water inside the shake-out device 2.

In the water sprinkling amount determining portion 34, the appropriate water sprinkling amount is determined on the basis of the water sprinkling amount calculated by the calculating portion 32. Some of the amount of heat of the loaded mold M loaded into the shake-out device 2 is dissipated outside the mold shake-out system 1. In the water sprinkling amount determining portion 34, the water sprinkling amount calculated by the calculating portion 32 is multiplied by a predetermined coefficient to determine the appropriate water sprinkling amount in expectation of this amount of heat that is dissipated (amount of dissipated heat). The coefficient used here is below 1.

On the basis of the determined appropriate water sprinkling amount, the water amount regulating valve 43 is controlled from the control portion 37 and water is sprinkled with the water sprinkling portion 4.

The fuel amount determining portion 36 determines the fuel combustion amount supplied from the fuel supply source 92 to the burner 91. In the fuel amount determining portion 36, the water vapor amount that the air introduced into the drum 21 of the shake-out device 2 can hold is calculated on the basis of the measurement data (temperature and humidity of introduced air) from the introduced air temperature and humidity measuring instrument 11 and the measurement data (airflow amount) from the airflow amount measuring instrument 16. The fuel amount determining portion 36 calculates the amount of fuel supplied to the burner 91 on the basis of the calculated water vapor amount and the amount of water sprinkled by the water sprinkling portion 4 by controlling the water amount regulating valve 43, and determines the combusted fuel amount. Specifically, when the water vapor amount that the air can hold is insufficient for the amount of vapor of the vapor latent heat for cooling the castings P and the molding sand S, the water vapor amount that the air can contain, by the air being heated, is increased. For this reason, the amount of fuel supplied to the burner 91 is determined such that the air discharged from the shake-out device 2 is at an air temperature allowing the air to contain water vapor of the amount of water sprinkled by the water sprinkling portion 4. By controlling the burner 91 by means of the control portion 37 on the basis of the determined combusted fuel amount, the air is heated by the air heating portion 9 and the air temperature discharged from the shake-out device 2 is adjusted.

Next, the configuration for performing evaluation and correction of the operating state of the mold shake-out system 1 in the control device 3 will be explained. In the mold shake-out system 1, there is a need to suppress the effects of temperature on for example a cleaning step and the handling of the castings P at subsequent steps by cooling the castings P. In addition, in the mold shake-out system 1, the recovered molding sand S needs to be stabilized. Accordingly, on the assumption that stable device operation of the mold shake-out system 1 is performed, the control device 3 executes control for performing operating state evaluation and correction for the mold shake-out system 1 such that the cooling of the castings P and the stabilization of the temperature and moisture of the recovered molding sand S can be performed reliably.

For this reason, the control device 3 further comprises an operating state evaluating and correcting portion 33 and a fuel amount correcting portion 35.

The operating state evaluating and correcting portion 33 corrects the water sprinkling amount determined by the water sprinkling amount determining portion 34 on the basis of the measured values (temperature of castings P) of the casting temperature measuring instrument 12 and the measured values (temperature and moisture of molding sand S) of the sand temperature and moisture measuring instrument 13. The appropriate water sprinkling amount corrected thereby is sprinkled by controlling the water amount regulating valve 43 from the control portion 37.

The operation state evaluating and correcting portion 33 takes measures against condensation by controlling the air heating portion based on the temperature and humidity of the discharged air discharged from the dust collecting device 5. For this reason, the operation state evaluating and correcting portion 33 evaluates adverse effects on equipment, such as condensation in the dust collecting device 5, on the basis of the temperature and humidity of the discharged air discharged from the shake-out device 2 measured by the discharged air temperature and humidity measuring instrument 14. If this evaluation results in a determination to correct the air introduced into the dust collecting device 5, this result is transmitted to the fuel amount correcting portion 35. In the fuel amount correcting portion 35, the correction amount of the combusted fuel amount for making the temperature of the air appropriate is determined based on the airflow amount, temperature, and humidity of the air discharged from the shake-out device 2. The data regarding the determined amount of combusted fuel correction is transmitted from the control portion 37 to the burner 91 and the combustion state of the burner 91 is adjusted. Consequently, the temperature and humidity of air discharged from the shake-out device 2 are controlled and adverse effects on equipment, such as condensation in the dust collecting device 5, are suppressed.

Herebelow, the flow of control in the control device 3 in operating the mold shake-out system 1 with a configuration such as that described above will be explained.

FIG. 3 is a flow chart illustrating the flow of control executed by the control device in the present embodiment.

First, the drive motor 24 is activated and the rotation of the drum 21 of the drum type shake-out device 20 is started. The air introducing device 7 is activated, air is introduced into the drum 21 of the shake-out device 2 from the loading side, and a flow of air is generated in which air flows from the shake-out device 2 to the hood 26 and then through the dust collecting device 5 to the air introducing device 7, from which the air is discharged. Subsequently, the operation preparation of equipment such as measuring instruments is completed and the operation of the mold shake-out system 1 is started (step S1).

Next, the loading of the loaded mold M into the shake-out device 2 by means of the mold conveying device 25 is started. The molding/pouring data regarding the loaded mold M being loaded is imported from the casting line control portion 100 into the data acquiring portion 31 of the control device 3 (step S2).

The molding/pouring data imported into the data acquiring portion 31 includes information regarding: the sand weight, temperature, moisture, and molding time of the mold F; and the material, temperature, pouring weight, and pouring time of the molten metal at the time of pouring. The data acquiring portion 31 calculates the amount of heat of the loaded mold M loaded into the shake-out device 2 on the basis of the acquired molding/pouring data.

The calculating portion 32 obtains the amount of heat of the castings P and the molding sand S when the temperature of the castings P discharged from the shake-out device 2 and the temperature and moisture of the recovered molding sand S reach the predetermined target values. Next, the calculating portion 32 subtracts the target amount of heat of the discharged castings P and the molding sand S from the amount of heat of the loaded mold M calculated by the data acquiring portion 31 to calculate the cooling heat amount by being cooled by the shake-out device 2. Furthermore, the calculating portion 32 calculates the water sprinkling amount corresponding to the calculated cooling heat amount.

In the water sprinkling amount determining portion 34, the calculated water sprinkling amount is multiplied by a coefficient to determine the appropriate water sprinkling amount in the expectation that some of the amount of heat of the loaded mold M loaded into the shake-out device 2 is dissipated outside the mold shake-out system 1 (step S3).

The data regarding the determined appropriate water sprinkling amount is transmitted from the control portion 37 to the water amount regulating valve 43, and water is sprinkled by controlling the water sprinkling amount in the water sprinkling portion 4. In the water amount regulating valve 43, a prescribed amount of water is sprinkled with a built-in integrated flow rate counter. At this time, regarding the sprinkled water, water is supplied in a batch for each loaded mold M. The flow rate per unit time from the water supply source 41 through the water sprinkling piping 42 (instantaneous flow rate) is obtained by dividing the maximum water sprinkling amount expected for one mold F to be shaken out by the minimum operation cycle (interval at which each mold F is loaded into the shake-out device 2) time of the casting line (step S4).

Next, the temperature and humidity of the air introduced into the shake-out device 2 are measured by the introduced air temperature and humidity measuring instrument 11, and the measured values are transmitted to the control device 3 (step S5).

Subsequently, the airflow amount of the air that has passed through the dust collecting device 5 is measured by the airflow amount measuring instrument 16, and the measured value is transmitted to the control device 3 (step S6).

Subsequently, the control device 3 determines the fuel combustion amount supplied from the fuel supply source 92 to the burner 91 with the fuel amount determining portion 36 (step S7). In the fuel amount determining portion 36, the water vapor amount that the air introduced into the shake-out device 2 can hold is obtained on the basis of the measured temperature and humidity of the air introduced into the shake-out device 2 and the airflow amount of the air that has passed through the dust collecting device 5. The fuel amount determining portion 36 calculates the amount of fuel supplied to the burner 91 on the basis of the calculated water vapor amount and the amount of water sprinkled by the water sprinkling portion 4 by controlling the water amount regulating valve 43, and determines the combusted fuel amount. Based on the determined combusted fuel amount, the burner 91 is controlled by means of the control portion 37 and the air temperature discharged from the shake-out device 2 is adjusted. Here, if the temperature of the air becomes high, the saturated vapor pressure will be high, making it possible for the air to contain more water vapor.

Next, the temperature of the castings P discharged from the shake-out device 2 is measured by the casting temperature measuring instrument 12, and the measured values are transmitted to the control device 3 (step S8). Subsequently, the temperature and moisture of the recovered molding sand S discharged from the shake-out device 2 are measured by the sand temperature and moisture measuring instrument 13, and those measured values are transmitted to the control device 3 (step S9).

Furthermore, the temperature and humidity of the air that has passed through the filter in the dust collecting device 5 are measured by the discharged air temperature and humidity measuring instrument 14, and those measured values are transmitted to the control device 3 (step S10).

Next, the control device 3 performs evaluation and correction of the operating state of the mold shake-out system 1 on the basis of the airflow amount of the discharged air, the temperature of the castings P discharged from the shake-out device 2, the temperature and moisture of the recovered molding sand S, and the temperature and humidity of the discharged air obtained at step S6 and steps S8-S10 (step S11). The evaluation and correction of the operating state in step S11 will be described later in more detail.

Next, the control device 3 determines whether to "Y: execute" or "N: do not execute" continuing the mold shake-out operation (step S12). In the case of "Y: execute", then after returning to step S2, the operations from step S2 onwards are repeated. In the case of "N: do not execute", the equipment activated at step S1 is sequentially stopped and this series of operations of the mold shake-out system 1 ends.

Next, the details of the evaluation and correction of the operating state in step S11 are discussed.

FIG. 4 is a flow chart illustrating the flow of evaluation and correction processes for an operating state of the mold shake-out system 1.

As illustrated in FIG. 4, the operating state evaluating and correcting portion 33 of the control device 3 first determines whether the temperature of the castings P discharged from the shake-out device 2 measured at step S8 is greater than or equal to the upper limit of a setting value (step S21). If the temperature is "Y: greater than or equal to upper limit", the process proceeds to step S25. In this case, the cooling of the castings P is not adequate, so a water sprinkling amount increasing correction is considered. The consideration regarding the amount increasing correction is explained in the later-described step S25. If the temperature is determined to be "N: less than or equal to upper limit", the temperature of the castings P discharged from the shake-out device 2 is below the upper limit of the specified value, and the castings P discharged from the shake-out device 2 have been adequately cooled. In this case, the water sprinkling amount increasing correction is not required, so the process proceeds to step S22.

At step S22, a determination is made as to whether the temperature of the recovered molding sand S measured at step S9 is greater than or equal to the upper limit of the setting value. If the temperature is "Y: greater than or equal to upper limit", the process proceeds to step S25. In this state, the cooling of the recovered molding sand S is not adequate, so the water sprinkling amount increasing correction is considered at the later-described step S25. If the temperature is determined to be "N: below upper limit", the temperature of the recovered molding sand S is below the upper limit of the specified value and the molding sand S discharged from the shake-out device 2 has been adequately cooled, meaning the water sprinkling amount increasing correction is not required, so the process proceeds to step S23.

At step S23, a determination is made as to whether the moisture of the molding sand S measured at step S9 is "Y: within" or "N: not within" the setting range. If the moisture is "Y: within" the range, the castings P and the recovered molding sand S discharged from the shake-out device 2 are in good condition, meaning the consideration of changing the water sprinkling amount is not required, so the process proceeds to step S27. If the moisture is "N: not within" the range, the process proceeds to step S24.

At step S24, furthermore, a determination is made as to whether the moisture of the recovered molding sand S is less than or equal to the lower limit of the setting value. If the moisture is "Y: less than or equal to lower limit", the process proceeds to step S25. In this state, the moisture of the recovered molding sand S has not been adequately secured, so the water sprinkling amount increasing correction is considered at step S25. If the moisture is determined to be "N: greater than or equal to lower limit", the moisture of the recovered molding sand S is in an excessive state, so the process proceeds to step S26 to perform a water sprinkling amount reducing correction.

At step S25, the water sprinkling amount for bringing the temperature of the castings P into the setting range is calculated. This involves obtaining the cooling heat amount based on the weight of the castings P and the specific heat and cooling temperature of the castings P. Assuming that the obtained cooling heat amount will be taken by the latent heat of vaporization of water, the required water sprinkling amount is obtained, which is used as the water sprinkling amount increasing correction value. This correction value is transmitted to the water sprinkling amount determining portion 34 and applied to the water sprinkled for the next loaded mold M loaded into the shake-out device 2.

At step S26, the amount of water obtained by multiplying the mold weight by the moisture of the excessive amount, determined at step S23 and step S24, is used as the water sprinkling amount reducing correction value. This correction value is transmitted to the water sprinkling amount determining portion 34 and applied to the water sprinkled for the next loaded mold M loaded into the shake-out device 2.

Next, the operating state evaluating and correcting portion 33 of the control device 3 performs amount increasing or amount reducing computation for the discharged air humidity and performs discharged air humidity correction in the cases in which the correction values in step S25 and step S26 were performed (step S27). More specifically, the humidity of the discharged air, due to the water vapor amount resulting from the evaporation of the water sprinkled in accordance with the water sprinkling amount correction, is computed and the humidity of the discharged air measured at step S10 is corrected.

Next, a determination is made as to whether the corrected humidity of the discharged air corrected at step S27 is "Y: within" or "N: not within" the setting range (step S28). If the corrected humidity is "Y: within" the range, the series of processes of step S11 for performing evaluation and correction of the operating state ends. If the corrected humidity is "N: not within" the range, the process proceeds to step S29.

At step S29, furthermore, a determination is made as to whether the corrected humidity of the discharged air is greater than or equal to the upper limit of the setting value. If the corrected humidity is "Y: greater than or equal to upper limit", the process proceeds to step S31. This state indicates that the humidity of the air discharged from the shake-out device 2 is high and there is a risk of condensation in the air passage. In this case, in order to raise the temperature of the discharged air and decrease the humidity of the discharged air, increasing the combusted fuel amount supplied from the fuel supply source 92 to the burner 91 is considered. The consideration regarding the amount increasing correction is explained in the later-described step S31. If the corrected humidity is determined to be "N: below upper limit", this means that, together with the determination in step S28, the corrected humidity is less than or equal to the setting range, there is no risk of condensation, and the consideration of increasing the combusted fuel amount is not required, so the process proceeds to step S30.

At step S30, a determination is made as to whether the air heating portion 9 is in an operating state. If the air heating portion 9 is "N: currently stopped", the series of processes of step S11 for performing evaluation and correction of the operating state ends. If the air heating portion 9 is "Y: running", the process proceeds to step S32.

At step S31, the correction of the combusted fuel amount is performed by the fuel amount correcting portion 35 of the control device 3 in response to the determination in step S29 that the humidity of the discharged air is high and there is a risk of condensation in the air passage. More specifically, in order to bring the humidity of the amount exceeding the setting value of the humidity of the discharged air into the setting range, the temperature of the air should be raised and the water vapor amount that the air can contain should be increased to lower the humidity. To that end, the amount of heat for raising the temperature of the air to a prescribed temperature is calculated, and the correction value is set such that the amount of fuel is increased by an amount corresponding to this amount of heat and supplied from the fuel supply source 92 to the burner 91. The set correction value is transmitted to the fuel amount determining portion 36.

If the process has proceeded from step S30 to step S32, this is a state in which the air heating portion 9 (burner 91) is running and the humidity of the discharged air is lower than the setting range, so in contrast to the case in which the humidity is high, the temperature of the discharged air should be lowered such that the humidity is within the setting range. To that end, the amount of heat for dropping the temperature of the air to a prescribed temperature is calculated and the correction value is set by reducing the amount of fuel by an amount corresponding to this amount of heat. The set correction value is transmitted to the fuel amount determining portion 36.

Note that in the series of processes described above, the correction of the water sprinkling amount was applied to the water sprinkled for the next loaded mold M loaded into the shake-out device 2, but the combusted fuel amount determined based on the correction value by the fuel amount determining portion 36 is immediately transmitted to the air heating portion 9 (burner 91) and applied. After undergoing these processes, the series of processes of step S11 for performing evaluation and correction of the operating state ends.

As stated above, the mold shake-out system 1 comprises a shake-out device 2 that separates a casting P and a mold F into the casting P and molding sand S, a water sprinkling portion 4 that sprinkles water in the shake-out device 2, and a control device 3 that controls the water sprinkling amount in the water sprinkling portion 4. The control device 3 adjusts the water sprinkling amount on the basis of molding/pouring data comprising molding data regarding a loaded mold M into which the casting has been poured and which is loaded into the shake-out device 2, pouring data regarding molten metal that forms the casting P, and time data from when the molten metal is poured into the mold F until when the mold F is loaded into the shake-out device 2.

According to such a configuration, the water sprinkling amount is adjusted on the basis of molding data, pouring data, molding/pouring data, and the target values of the temperature of the casting P and the temperature and moisture of the molding sand S. This makes it possible to obtain the amount of heat of the mold F, into which the casting P has been poured, before the mold F is loaded into the shake-out device 2. Accordingly, it is possible to precisely determine the water sprinkling amount for cooling the casting P and the molding sand S by adjusting the water sprinkling amount on the basis of the obtained amount of heat. Accordingly, it is possible to suppress the occurrence of an excessive or insufficient water sprinkling amount with higher accuracy and adjust the water sprinkling amount in mold shake-out with higher accuracy.

In addition, the mold shake-out system 1 further comprises a casting temperature measuring instrument 12 that measures the temperature of the casting P discharged from the shake-out device 2 and a sand temperature and moisture measuring instrument 13 that measures the temperature and moisture of the molding sand S discharged from the shake-out device 2. The control device 3 adjusts the water sprinkling amount on the basis of the temperature of the casting P discharged from the shake-out device 2 and the temperature and moisture of the molding sand S in addition to the molding data regarding the loaded mold M, the pouring data regarding the molten metal, and the molding/pouring data.

According to such a configuration, by adjusting the water sprinkling amount on the basis of the target values of the temperature of the casting P and the temperature and moisture of the molding sand S in addition to the molding data, the pouring data, and the molding/pouring data, it is possible to suppress the occurrence of an excessive or insufficient water sprinkling amount with greater accuracy and to adjust the water sprinkling amount in mold shake-out with higher accuracy.

In addition, the mold shake-out system 1 comprises an air introducing device 7 that introduces air into the shake-out device 2, an introduced air temperature and humidity measuring instrument 11 that measures the temperature and humidity of the air introduced into the shake-out device 2, and an airflow amount measuring instrument 16 that measures the airflow amount of the air, and the control device 3 adjusts the water sprinkling amount on the basis of the temperature, humidity, and airflow amount of the introduced air.

According to such a configuration, it is possible to suppress the occurrence of an excessive or insufficient water sprinkling amount with greater accuracy by adjusting the water sprinkling amount on the basis of the temperature, humidity, and airflow amount of the air introduced into the shake-out device 2.

In addition, the mold shake-out system 1 further comprises a dust collecting device 5 that removes dust contained in the air discharged from the shake-out device 2 and a discharged air temperature and humidity measuring instrument 14 that measures the temperature and humidity of the discharged air discharged from the dust collecting device 5, and the control device 3 adjusts the water sprinkling amount on the basis of the temperature and humidity of the air measured by the introduced air temperature and humidity measuring instrument 11, the airflow amount measured by the airflow amount measuring instrument 16, and the temperature and humidity of the discharged air measured by the discharged air temperature and humidity measuring instrument 14.

According to such a configuration, the water sprinkling amount is adjusted on the basis of the temperature, humidity, and airflow amount of the air introduced into the shake-out device 2, and the temperature and humidity of the discharged air. This makes it possible to obtain the amount of heat taken from the casting P and the molding sand S by the latent heat of vaporization when sprinkled water evaporates inside the shake-out device 2. By adjusting the water sprinkling amount on the basis of the amount of heat obtained in this manner, it is possible to suppress the occurrence of an excessive or insufficient water sprinkling amount with greater accuracy.

In addition, the mold shake-out system 1 further comprises an air heating portion 9 that heats the air inside the shake-out device 2, and the control device 3 adjusts the temperature and humidity of the air discharged from the shake-out device 2 and fed into the dust collecting device 5 by controlling the air heating portion 9 on the basis of the temperature and humidity of the air measured by the introduced air temperature and humidity measuring instrument 11, the airflow amount measured by the airflow amount measuring instrument 16, and the temperature and humidity of the discharged air measured by the discharged air temperature and humidity measuring instrument 14.

According to such a configuration, it is possible to obtain the amount of heat taken from the casting P and the molding sand S by the latent heat of vaporization when sprinkled water evaporates inside the shake-out device 2 on the basis of the temperature, humidity, and airflow amount of the air introduced into the shake-out device 2 and the temperature and humidity of the discharged air. By adjusting the combusted fuel amount supplied to the burner 91 on the basis of the amount of heat obtained in this manner, it is possible to adjust the amount of hot air fed into the shake-out device 2 and to adjust the temperature and humidity of the air fed into the dust collecting device 5. As a result, it is possible to suppress condensation in the air introduction path from the shake-out device 2 to the air introducing device.

The mold shake-out system 1 described above is a mold shake-out system 1 that separates a mold F, into which a casting P has been poured, into the casting P and molding sand S, the mold shake-out system 1 further comprising: a shake-out device 2 that separates the casting P and the mold F into the casting P and the molding sand S; an air introducing device 7 that introduces air into the shake-out device 2; an airflow amount measuring instrument 16 that measures the airflow amount of the air; an air heating portion 9 that heats the air inside the shake-out device 2; a dust collecting device 5 that removes dust contained in the air discharged from the shake-out device 2; a discharged air temperature and humidity measuring instrument 14 that measures the temperature and humidity of the discharged air discharged from the dust collecting device 5; and a control device 3 that controls the air heating portion 9; and the control device 3 adjusts the temperature and humidity of the air discharged from the shake-out device 2 and fed into the dust collecting device 5 by controlling the air heating portion 9 on the basis of the airflow amount measured by the airflow amount measuring instrument 16 and the temperature and humidity of the discharged air measured by the discharged air temperature and humidity measuring instrument 14.

According to such a configuration, it is possible to obtain the amount of heat taken from the casting P and the molding sand S by the latent heat of vaporization when sprinkled water evaporates inside the shake-out device 2 on the basis of the temperature, humidity, and airflow amount of the air introduced into the shake-out device 2 and the temperature and humidity of the discharged air. By adjusting the combusted fuel amount supplied to the burner 91 on the basis of the amount of heat obtained in this manner, it is possible to adjust the amount of hot air fed into the shake-out device 2 and to adjust the temperature and humidity of the air fed into the dust collecting device 5. As a result, it is possible to suppress condensation in the air introduction path from the shake-out device 2 to the air introducing device. This makes it possible to suppress the effects of an excessive or insufficient water sprinkling amount from influencing the dust collecting device 5 downstream of the shake-out device 2.

In addition, the mold shake-out system 1 further comprises an introduced air temperature and humidity measuring instrument 11 that measures the temperature and humidity of air introduced into the shake-out device 2. The control device 3 adjusts the temperature and humidity of the air discharged from the shake-out device 2 and fed into the dust collecting device 5 by controlling the air heating portion 9 on the basis of the temperature and humidity of the air measured by the introduced air temperature and humidity measuring instrument 11, the airflow amount measured by the airflow amount measuring instrument 16, and the temperature and humidity of the discharged air measured by the discharged air temperature and humidity measuring instrument 14.

According to such a configuration, it is possible to adjust the amount of hot air fed into the shake-out device 2 and to adjust the temperature and humidity of the air fed into the dust collecting device 5 by adjusting the combusted fuel amount supplied to the burner 91 on the basis of the temperature and humidity of the air introduced into the shake-out device 2, in addition to the airflow amount introduced into the shake-out device 2 and the temperature and humidity of the discharged air. As a result, it is possible to suppress condensation in the air introduction path from the shake-out device 2 to the air introducing device. This makes it possible to more reliably suppress the effects of an excessive or insufficient water sprinkling amount from influencing the dust collecting device 5 downstream of the shake-out device 2.

In addition, regarding the mold shake-out system 1, the heat source of the air heating portion 9 is a fossil fuel.

According to such a configuration, it is possible to suppress the effects of an excessive or insufficient water sprinkling amount in shake-out of molds F.

Other Embodiments

The mold shake-out system of the present invention is not to be construed as being limited to the embodiment disclosed above that was explained with reference to the drawings, and many variations may be contemplated within the technical scope thereof.

For example, the mold shake-out system 1 is configured to comprise a rotating drum type shake-out device 2 in the abovementioned embodiment, but the configuration is not limited thereto.

For example, the mold shake-out system 1 may comprise a trough vibration type shake-out device 2B, as illustrated in FIG. 5. The trough vibration type shake-out device 2B comprises a vibrating trough 201 and an oscillator 202 for vibrating the vibrating trough 201. The loaded mold M is loaded onto the vibrating trough 201. The vibrating trough 201 is vibrated by the oscillator 202, which causes the loaded mold M on the vibrating trough 201 to be broken down and separated into the castings P and the molding sand S while moving to the discharge side.

In addition to the above, a drum vibration type shake-out device that vibrates the drum into which the loaded mold M is loaded, without rotating the drum, can be used as the shake-out device.

In addition, it is also possible to apply, to the mold shake-out system, a case in which a mechanism that cools the castings P and the molding sand S has been combined with the device for subjecting the mold F to shake-out.

In addition to the above, it is possible to mix and match the configurations indicated in the embodiments described above and to appropriately modify the configurations to other configurations, without departing from the spirit of this invention.

REFERENCE SIGNS LIST

1 Mold shake-out system
2 Shake-out device
2B Shake-out device
3 Control device (air heating control device)
4 Water sprinkling portion
5 Dust collecting device
7 Air introducing device (air introducing portion)
9 Air heating portion
11 Introduced air temperature and humidity measuring instrument (introduced air temperature and humidity measuring portion)
12 Casting temperature measuring instrument (casting temperature measuring portion)
13 Sand temperature and moisture measuring instrument (sand temperature and moisture measuring portion)
14 Discharged air temperature and humidity measuring instrument (discharged air temperature and humidity measuring portion)
16 Airflow amount measuring instrument (airflow amount measuring portion)
F Mold
M Loaded mold
P Casting
S Molding sand

The invention claimed is:

1. A mold shake-out system that separates a mold, into which a casting has been poured, into the casting and molding sand, the mold shake-out system comprising:

a shake-out device that separates the casting and the mold into the casting and the molding sand;

a water sprinkling portion that sprinkles water in the shake-out device; and a processor programmed to control a water sprinkling amount output by the water sprinkling portion;

an air introducing portion that introduces air into the shake-out device;

an introduced air temperature and humidity measuring portion that measures the temperature and humidity of the air introduced into the shake-out device; and an airflow amount measuring portion that measures the airflow amount of the air, wherein the processor is further programmed to adjust the water sprinkling amount on the basis of molding/pouring data comprising molding data regarding the mold into which the casting has been poured and which is loaded into the shake-out device, pouring data regarding molten metal that forms the casting, and time data from when the molten metal is poured into the mold until when the mold is loaded into the shake-out device, and the temperature, humidity, and airflow amount of the introduced air.

2. The mold shake-out system according to claim 1, further comprising:

a casting temperature measuring portion that measures the temperature of the casting discharged from the shake-out device; and a sand temperature and moisture measuring portion that measures the temperature and moisture of the molding sand discharged from the shake-out device;

wherein the processor is further programmed to adjust the water sprinkling amount on the basis of:

the molding data regarding the mold, the pouring data regarding the molten metal, and the molding/pouring data;

the temperature of the casting discharged from the shake-out device; and the temperature and moisture of the molding sand.

3. The mold shake-out system according to claim 1 further comprising:

a dust collecting device that removes dust contained in the air discharged from the shake-out device; and a discharged air temperature and humidity measuring portion that measures the temperature and humidity of discharged air discharged from the dust collecting device;

wherein the processor is further programmed to adjust the water sprinkling amount on the basis of:

the temperature and humidity of the air measured by the introduced air temperature and humidity measuring portion;

the airflow amount measured by the airflow amount measuring portion; and the temperature and humidity of the discharged air measured by the discharged air temperature and humidity measuring portion.

4. The mold shake-out system according to claim 3, further comprising:

an air heating portion that heats air inside the shake-out device;

wherein the processor is further programmed to adjust the temperature and humidity of the air discharged from the shake-out device and fed into the dust collecting device by controlling the air heating portion on the basis of:

the temperature and humidity of the air measured by the introduced air temperature and humidity measuring portion;

the airflow amount measured by the airflow amount measuring portion; and the temperature and humidity of the discharged air measured by the discharged air temperature and humidity measuring portion.

* * * * *